US006602176B1

(12) United States Patent
Ganneval

(10) Patent No.: US 6,602,176 B1
(45) Date of Patent: Aug. 5, 2003

(54) METHOD AND DEVICE FOR FOLDING SHEET-LIKE COPIES

(75) Inventor: Bernard Ganneval, Paris (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 144 days.

(21) Appl. No.: 09/718,706

(22) Filed: Nov. 22, 2000

(30) Foreign Application Priority Data

Nov. 23, 1999 (DE) ..... 199 56 248
Jun. 28, 2000 (FR) ..... 00 08298

(51) Int. Cl.[7] ..... B31B 1/26
(52) U.S. Cl. ..... 493/405; 493/424; 493/427; 493/431
(58) Field of Search ..... 493/405, 424, 493/427, 434, 435, 442, 454, 476, 431

(56) References Cited

U.S. PATENT DOCUMENTS 3,576,051 A * 4/1971 Click
4,493,690 A * 1/1985 Niemiro et al. ..... 493/454
4,717,375 A * 1/1988 Lundmark ..... 493/427
4,781,667 A * 11/1988 Kitai ..... 493/434

FOREIGN PATENT DOCUMENTS

DE 29 05 545 A1 8/1980
DE 37 43 642 A1 7/1989
EP 0 663 363 A1 7/1995

* cited by examiner

*Primary Examiner*—Eugene Kim
*Assistant Examiner*—Sameh Tawfik
(74) *Attorney, Agent, or Firm*—Laurence A. Greenberg; Werner H. Stemer; Ralph E. Locher

(57) ABSTRACT

A method for folding sheet-like copies, respectively, made up of a plurality of copy layers, whereby open ends and closed folding spines are formed on the copies by folding operations, which comprises forming the folding spine on the inner copy layers of the copy in a manner that the folding spine is interrupted by non-folded sections; a device for performing the method; a folder for performing the method; and a folding copy foldable by the method.

17 Claims, 5 Drawing Sheets

METHOD AND DEVICE FOR FOLDING SHEET-LIKE COPIES

BACKGROUND OF THE INVENTION

Field of the Invention

The invention relates to a method and a device for folding sheet-like copies, for example folding copies, which are produced in folders arranged downline from web-processing rotary printing machines.

Heretofore disclosed in the prior art, by way of the published European Patent Document EP 0 663 363 B1, is an arrangement for guiding web-like materials with at least one roller core and a plurality of lamella rings positioned thereon, and also a process for producing the arrangement. For guiding web-like materials, for example paper, textile or sheet-material webs, the arrangement is provided with at least one roller core and a plurality of lamella rings which are positioned thereon and formed of an elastic material. The lamella rings are arranged symmetrically to the axial central plane of the roller core and are lined up, in a mirror-inverted manner, in rows extending outwardly from the center. Axially abutting one another, they form a virtually continuous surface. The lamella rings have at least one predetermined point of inflection, the cross section of the lamella rings being somewhat Z-shaped.

When subjected to radial pressure, for example initiated by stressing which is exerted via an outgoing material web, the outer circumference is displaced axially and symmetrically to the axial center plane. In this regard, the cylindrical surface maintains the parallelism thereof to the roller axis. In this construction known heretofore from the prior art, the lamella rings may preferably be produced from (natural) rubber, plastics or similar materials.

The published German Non-prosecuted Patent Application (DE-OS) 29 05 545 is concerned with a folding roller. Coverings formed of pliant or yieldable plastic material are inserted in the jacket of the folding roller. Roller-surface regions formed of metallic material are left free between the coverings, the inserted coverings projecting slightly beyond the metallic-material regions. The coverings are prefabricated rings formed of slightly elastically deformable, for example elastomeric, plastic material. The rings can be inserted under prestressing in annular grooves which are provided in the roller jacket, the rings having, over the entire width thereof, a grooved arrangement formed by grooves extending at least approximately parallel to the folding-roller axis. The metallic surface regions between the rings, in contrast, have a smooth groove-free surface. This construction is intended to provide a folding roller which executes a particularly reliable conveying operation, allows air to flow out without obstruction, can be produced relatively straightforwardly and inexpensively, has a relatively long service life and has regions subjected predominantly to wear, which are renewable, as such, relatively easily.

Moreover, the published German Patent Document DE 37 43 642 A1 has disclosed a further folding roller. This folding roller has a cylindrical core element whereon, in order to form recesses at predetermined positions, sleeve-like sections formed of elastomeric material, and sleeve-like sections formed of metal are arranged so that they are displaceable relative to one another. In order to ensure that the metal sleeve-sections, which are knurled on the outside, are secured against relative rotation, circumferential grooves are recessed in the inner surface of the sections, and O-rings formed of elastomeric material are inserted in the circumferential grooves. Axial displacement of the metal sleeve-like sections is possible due to the O-rings, yet a friction lock in the circumferential direction is assured at all times. With this construction, it is possible, in an extremely straightforward manner, to adjust the recess between the individual sections in accordance with respectively provided linear applications of glue.

With multilayered folding copies, such as folded products having, for example, 8, 16, 24, 32, 48 or 64 pages, the folds of the innermost copy layers may rupture. Upon opening a multilayered folding copy which is held together at the folding spine thereof by connecting elements, for example, staples, it is possible, with fold rupturing, for the innermost layer to drop out of the copy, for example, a periodical or a magazine, because it is no longer held in place; the staples cannot any longer exert a retaining force on the innermost copy layer, which is also referred to as the central layer. At the folding spine thereof, the central layer undergoes a deflection of approximately 180°, due to which the respective printing substrate is subjected to very high stressing. Due to the printing, the subsequent drying, and the remoistening and cooling of the web, the printing substrate of the material web is exposed to widely varying thermal influences, as a result of which the mechanical properties thereof can change very unfavorably. In particular, the mechanical stability of the web may be reduced considerably by embrittlement, with the result that pronounced stressing, for example, in the form of a 180°-deflection, promotes the occurrence of fold ruptures. The rest of the layers which enclose the central layer are relatively unsusceptible to the occurrence of fold ruptures because the folding spine in each copy layer becomes rounded to an appreciable extent as the number of copies increases.

SUMMARY OF THE INVENTION

Departing from the aforementioned technical problem and the outlined prior-art solutions therefor, it is an object of the invention to provide a method and device for folding sheetlike copies, which avoids the occurrence of fold ruptures on folding copies and increases the copy quality to a significant extent.

With the foregoing and other objects in view, there is provided, in accordance with one aspect of the invention, a method for folding sheet-like copies, respectively, made up of a plurality of copy layers, whereby open ends and closed folding spines are formed on the copies by folding operations, which comprises forming the folding spine on the inner copy layers of the copy in a manner that the folding spine is interrupted by non-folded sections.

In accordance with another mode, the method of the invention includes maintaining the folding spine rounded in the region of the non-folded sections.

In accordance with a further mode, the method of the invention includes locating the non-folded sections of the folding spine in a region of stapling or stitching positions.

In accordance with an added mode, the method of the invention includes arranging the stapling or stitching positions on the folding spine in a format-dependent manner.

In accordance with an additional mode, the method of the invention includes forming the folding spine parallel to the grain of material forming the copy.

In accordance with yet another mode, the method of the invention includes forming the folding spine with non-folded sections by pushing the copy layers into a nip between folding rollers.

In accordance with yet a further mode, the method of the invention includes forming the folding spine with non-folded sections, during a cross-folding operation, upon transfer of the copies from one copy-guiding cylinder to a next following copy-guiding cylinder.

In accordance with another aspect of the invention, there is provided a device for folding sheet-like copies, respectively, made up of a plurality of copy layers, the copies being formed by folding operations with regions having open ends and closed folding-spine regions, and folding components for producing the folding-spine regions on the copies, at least one of the folding components being provided for acting linearly on the copy layers of a multi-layered folding copy, comprising surfaces defining recesses provided in the folding components for forming a folding spine on the copy layers of the respective copies, the folding spine including non-folded sections and longitudinally folded sections.

In accordance with a further feature of the invention, the recesses are formed on the folding components with a width corresponding to a measurement of the non-folded sections.

In accordance with an added feature of the invention, the recesses have a depth in the folding components which produces spaces, in the region of the folding spine, for surrounding connecting elements.

In accordance with an additional feature of the invention, the recesses are arranged on the folding components in a format-dependent manner.

In accordance with yet another feature of the invention, for stapling or stitching positions for a first folding format, the recesses are arranged at a given spacing A on an untrimmed length of the copy layers.

In accordance with yet a further feature of the invention, a recess, for a stapling or stitching position for a second folding format, is arranged at a given spacing B approximately in the center of an untrimmed length of the copy layer.

In accordance with yet an added feature of the invention, the recess is provided as a revolving annular groove formed in folding rollers defining a folding nip.

In accordance with yet an additional feature of the invention, the recesses are formed as pockets in jacket surfaces of the folding components formed as folding rollers.

In accordance with still another feature of the invention, the pockets are formed on the circumference of the folding rollers so that the pockets extend over a circular-arc sector of the respective jacket surface.

In accordance with still a further feature of the invention, the recesses are arranged on a folding blade in a region of a folding edge of a second longitudinal folding arrangement.

In accordance with an additional aspect of the invention, there is provided a folding copy formed of a plurality of copy layers with open ends and closed regions on a folding spine, the folding spine comprising inner copy layers including non-folded regions with a rounded formation and longitudinally folded regions.

In accordance with a concomitant aspect of the invention, there is provided a folder for folding sheet-like copies, respectively, made up of a plurality of copy layers, the copies being formed by folding operations with regions having open ends and closed folding-spine regions, and folding components for producing the folding-spine regions on the copies, at least one of the folding components being provided for acting linearly on the copy layers of a multi-layered folding copy, comprising surfaces defining recesses provided in the folding components for forming a folding spine on the copy layers of the respective copies, the folding spine including non-folded sections and longitudinally folded sections.

The advantages which can be achieved by the method and device. according to the invention are diverse in nature. The arrangement of non-folded zones, which is distributed over the length of the folding spine, avoids excessive weakening of the printing substrate. The material regions which remain non-folded in the region of the folding spines of the innermost copy layers of a multilayered copy give the innermost copy layers a higher mechanical strength, with the result that excessive weakening of respective layers is avoided in the region of the folding spines of the innermost layer, parallel to the grain direction. This provides, in the folding spine of the copy material, material bridges which, by virtue of the avoidance of any weakening, in particular in the region of the connecting zones of the copy layers, provide a reliable hold for the connecting element, for example, staples or stitching.

In an advantageous refinement of the method proposed according to the invention, the non-folded sections of the innermost copy layers remain rounded and thus provide sufficient space for closing the connecting elements of the copy layers, for example, staples or stitching. The non-folded regions of the folding spine are preferably placed in the positions in which, at a later stage, the staples or stitching are introduced into the copy in order to hold the individual copy layers together. The stapling or stitching position and thus the position of the non-folded regions of the folding spine are preferably placed in format-dependent positions, for example in the head and foot regions of an A4-copy or in the border regions of a delta-fold copy.

In order to minimize the mechanical stressing to which the printing substrate is subjected, the folding spines which are to be produced are preferably located parallel to the grain direction in the printing substrate.

According to another mode of the method, a folding spine may be formed with these interrupting non-folded sections by the copy layers or the copies being pushed into a nip between folding rollers. This allows the folding-spine formation proposed according to the invention to be used in the production of a second longitudinal fold in the folder; a further mode of the method is for the folding spine, interrupted by non-folded sections, to be formed, during the cross-folding operation, upon transfer of the copy layers from the circumference of one copy-guiding cylinder onto the next copy-guiding cylinder, for example the jaw cylinder in the case of cross folding.

The device proposed according to the invention is intended for folding sheet-like copies which include a plurality of copy layers, and comprises folding components which, for their part, are provided with recesses or cutouts forming the respective folding spine on the individual copy layers of a multilayered copy, the folding spine, for its part, being interrupted by non-folded sections. In an advantageous configuration, the recesses are formed on the folding components in a width which corresponds to the longitudinal dimension of a non-folded section on the folding spine of the copy layers. In addition to such longitudinal dimensions of the non-folded regions, it is possible for the depth of the recesses in the folding components to produce, in the region of the folding spine, a space which encloses the connecting elements, such as staples or stitching, for example.

The individual recesses are preferably arranged on the folding components in a format-dependent manner, in particular, recesses for stapling or stitching positions for a first folding format being arranged at a spacing A on the untrimmed length of the copy layers, and also recesses for stapling positions for a second folding format are arranged at a spacing B approximately in the center of the untrimmed length of the copy layers. The recesses on the folding components may be formed as continuously encircling or revolving annular grooves in mutually cooperating folding rollers which, for their part, define a folding nip. Another embodiment results from forming the recesses as pockets in the respective jacket surfaces of the folding rollers, the pocket length in the circumferential direction being such that a circular-arc sector of the jacket surface of the respective folding roller defines the pocket length. Finally, it is possible to arrange the recesses on a folding blade of a second longitudinal folding arrangement, the recesses, which are likewise recessed again in a format-dependent manner, being formed in the edge region of the folding blade by which the latter acts upon the copy layers, which are to be folded linearly, as they are pushed between the folding rollers.

By the method and device proposed according to the invention, it is possible to produce folding copies comprising a plurality of copy layers, the ends of which are open and which have a closed folding-spine region, the folding spine of inner copies containing non-folded regions with a rounded formation.

The solution proposed according to the invention for forming a fold on sheet-like copies, whether this is a cross fold, longitudinal fold, delta fold, a double parallel fold or the like, may advantageously be used in folders which may be arranged downline of web-processing or sheet-processing rotary printing machines. The folder may be equipped with sets of pins, but the folder may also be one which operates without pins. In addition to a possible use downline of sheet-processing rotary printing machines, the solution according to the invention can be used particularly advantageously in web-processing printing machines, for example, for newspaper or web job printing.

Other features which are considered as characteristic for the invention are set forth in the appended claims.

Although the invention is illustrated and described herein as embodied in a method and device for folding sheet-like copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
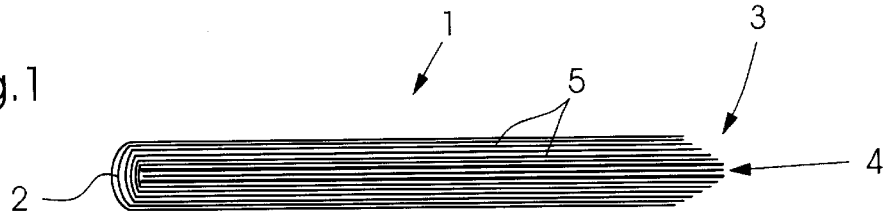
FIG. 1 is a diagrammatic side view of a multilayered folding copy with open end regions and folding spines arranged so that they extend in a copy-transporting direction.

Referring now to the drawings and, first, particularly to FIG. 1 thereof, there is shown therein a multilayered copy 1 made up of an innermost central layer 4 and further copy layers 5 enclosing the central layer 4. A copy spine 2 is oriented in the copy-transporting direction within the folding copy, while open copy ends 3 are located on the opposite side of the multilayered folding copy 1 from the spine 2 thereof. It is believed to be apparent from FIG. 1 that the central layer 4 undergoes a deflection of approximately 180° in the region of the folding spine 2, while the further copy layers 5 enclosing the central layer have an increasingly rounded folding spine as the number of copy layers increases, this rounded folding spine being less susceptible to fold rupturing because the rounded portions are subjected to lower mechanical stressing.

Figure 1A:
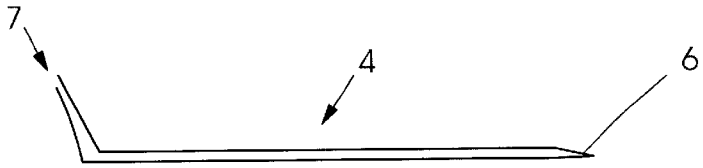
FIG. 1*a* is a fragmentary view of FIG. 1 showing the innermost layer of the multilayered folding copy.

The central layer 4 of a folding copy 1 is illustrated in FIG. 1*a*. In the region of the central-layer spine 6, the central layer 4 undergoes a deflection of 180°, as a result of which the material, which has already been subjected to stressing by the processing steps which include printing, drying, remoistening and cooling, is subjected to additional pronounced mechanical loading. The open ends 7 of the central layer 4 are illustrated opposite the central-layer spine 6.

Figure 1B:
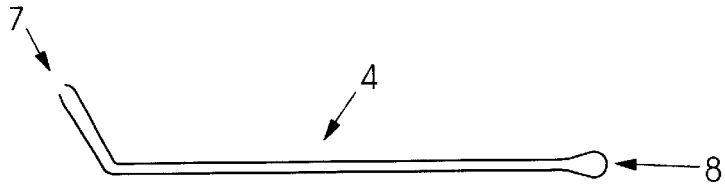
FIG. 1*b* is a view like that of FIG. 1*a* shows the formation, in accordance with the invention, of regions of the folding spine by the proposed method according to the invention.

A central layer 4 of a copy 1 which is folded according to the invention is illustrated in FIG. 1*b*. Located opposite the open ends 7 of the central layer 4 is a rounded folding spine, of which the rounded formation 8 constitutes a non-folded region in the folding spine of a copy layer. The non-folded region is described in greater detail hereinbelow.

Figure 2:
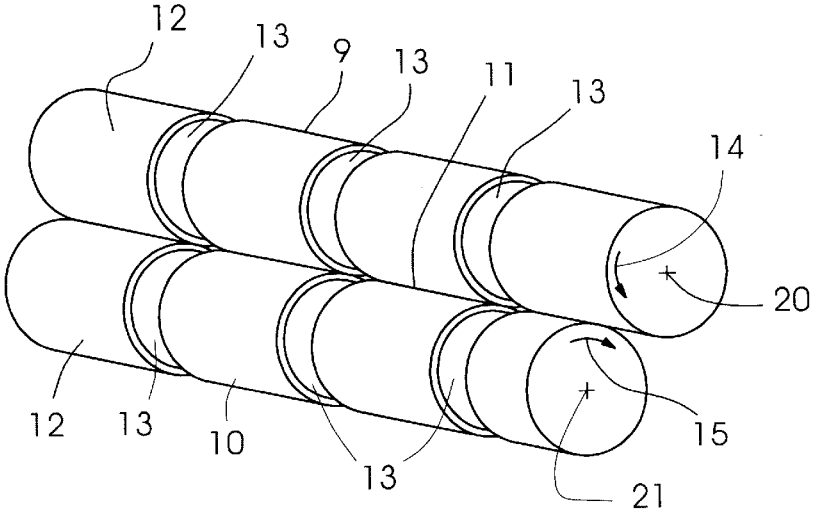
FIG. 2 is a perspective view of mutually cooperating folding rollers defining a folding nip therebetween, and being formed on the circumferences thereof with encircling recesses which are located opposite one another.

A possible construction of folding components by which it is possible to realize the folding-spine formation proposed according to the invention is illustrated in FIG. 2. Two folding rollers 9 and 10, which define a folding nip 11 therebetween, have cooperating jacket surfaces 12, which are interrupted by annular recesses or cutouts 13, respectively, located opposite one another. The first folding roller 9 rotates about a rotational axis 20 in a counterclockwise direction, as represented by the arrow 14 in FIG. 2, while the second folding roller 10, which cooperates with the first folding roller 9, rotates about a rotational axis 21 in a clockwise direction 15 corresponding to that of the arrow 15 in FIG. 2. As a result, folding copies which are pushed into the folding-roller nip 11 by a non-illustrated further folding component are folded longitudinally in a second longitudinal folding arrangement of a folder, non-folded regions remaining along the folding spine due to the mutually aligned recesses 13 formed on the circumferential or jacket surfaces 12 of the first folding roller 9 and the second folding roller 10.

Figure 2A:
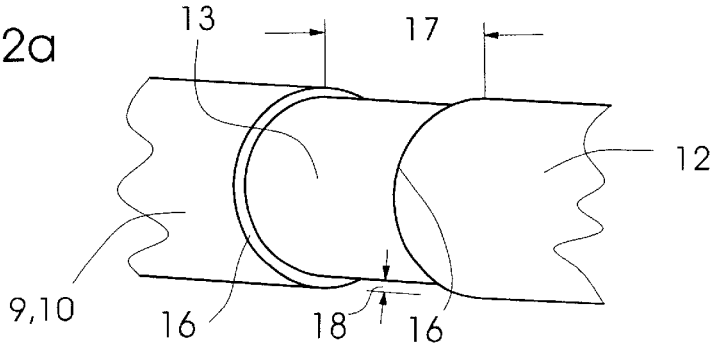
FIG. 2*a* is an enlarged fragmentary view of FIG. 2 showing one of the recesses formed on the circumference of one of the folding rollers.

FIG. 2*a* illustrates one of the annular recesses 13 on a larger scale. The annular recess 13 interrupts the jacket surface 12 of the first folding roller 9 and of the second folding roller 10. The recess 13 is defined by two edges 16, the width dimensions 17 of the recess 13 on the jacket surface 12 of the first folding roller 9 and of the second folding roller 10 being such that the non-folded sections 41 which later remain in the folding spine (note FIG. 6) have a length which exceeds that of the connecting elements, which are formed as staples. The depth 18 of the annular recesses 13 may be, for example, half a millimeter, with the result that the formation of the non-folded regions 41 (note FIG. 6) on the folding copies 4, 6 forms spaces enclosing the connecting elements, which are formed as staples.

Figure 2B:
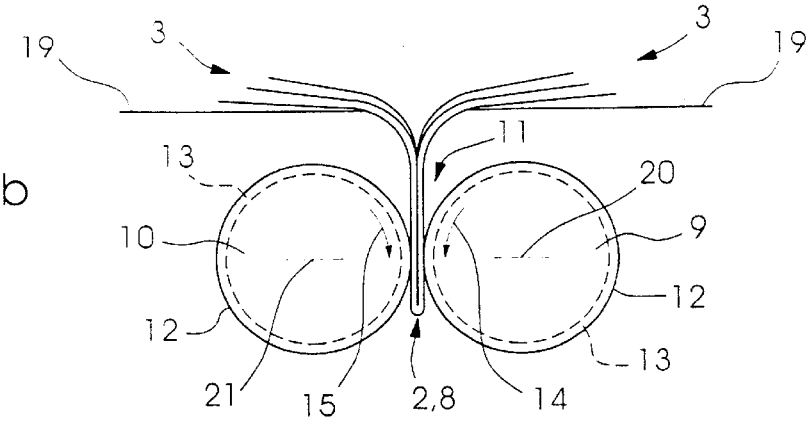
FIG. 2*b* is an enlarged diagrammatic end view of the two cooperating folding rollers according to FIG. 2 and showing a folding copy running from a folding table into a folding nip between the two folding rollers.

The cooperating first folding roller 9 and second folding roller 10 are illustrated in greater detail in FIG. 2*b*. Within the context of a second longitudinal folding operation, the multilayered folding copy is pushed into the folding nip 11 with the folding spine 2, 8 in front, extending into the folding-roller nip 11 from a folding table 19, which supports the side surfaces of the copies. The folding spine 6 is formed on the copy by the first and second rollers 9 and 10 rotating about the respective rotational axes 20 and 21 thereof, while, due to the mutually opposite annular recesses, represented by broken lines in FIG. 2*b*, the non-folded regions 41 (note FIG. 6) interrupt the folding spine 6. Analogously to that arrangement of the folding rollers such as is illustrated in FIG. 2, the first folding roller 9 rotates in the counterclockwise direction represented by the arrow 14, while the second folding roller 10, which cooperates with the first folding roller 9, rotates in the clockwise direction represented by the arrow 15. The open copy ends 3 are illustrated above the folding table 19, which is indicated only diagrammatically in FIG. 2*b*.

Figure 3:
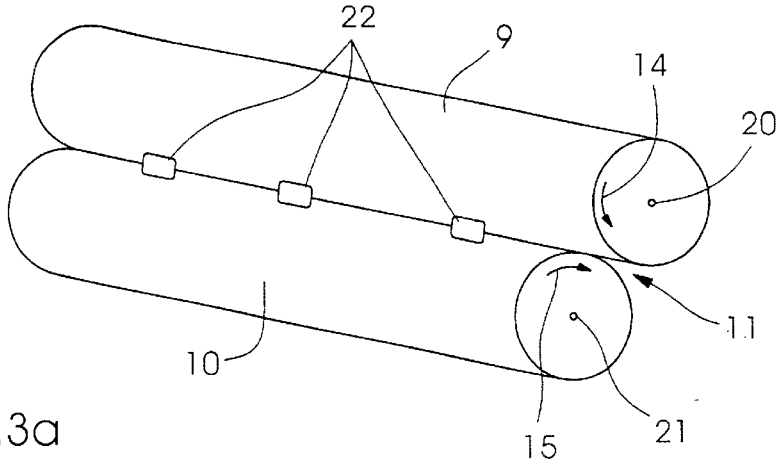
FIG. 3 is a view like that of FIG. 2 of another embodiment of the two cooperating folding rollers defining a nip and the circumferences of the folding rollers being formed with respective pockets which are located opposite one another.

Another embodiment of recesses in folding components is represented in FIG. 3. Illustrated in this configuration are a first folding roller 9 and a second folding roller 10, which rotate about the respective rotational axes 20 and 21 thereof. The first folding roller 9 rotates in counterclockwise direction as represented by the arrow 14, while the second folding roller 10 rotates clockwise in the direction of the arrow 15, diagrammatically indicated pockets 22 being formed on the circumferential or jacket surfaces 12 of the first folding roller 9 and the second folding roller 10, respectively. Analogously to the embodiment illustrated in FIG. 2, the first folding roller 9 and the second folding roller 10 define a roller nip 11 therebetween into which a copy which is to be folded longitudinally, for example, in a second longitudinal folding arrangement, is pushed by a folding blade (not illustrated in FIG. 3).

Figure 3A:
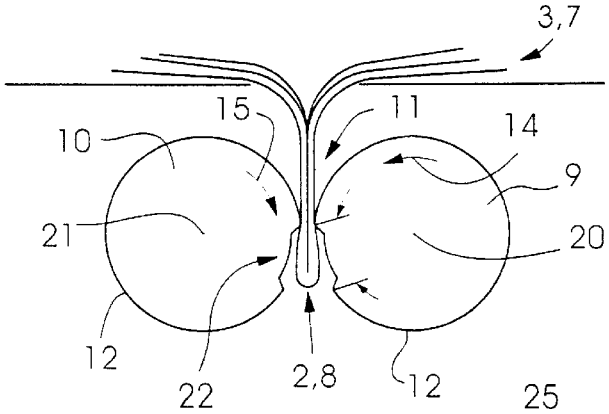
FIG. 3*a* is a view like that of FIG. 2*b* of the embodiment of FIG. 3, showing a multilayered copy running into a nip between the two cooperating folding rollers formed with respective opposing pockets.

A multilayered copy running into the folding-roller nip 11 between two cooperating folding components 9 and 10 according to FIG. 3 is illustrated in greater detail in FIG. 3*a*.

The first folding roller 9 and the second folding roller 10 rotate in the respective rotational directions represented by the arrows 14 and 15 and about the respective rotational axes 20 and 21, as have already been illustrated hereinbefore. The pockets 22 according to FIG. 3 are accommodated on the jacket surfaces 12 of the first folding roller 9 and of the second folding roller 10 and, in accordance with the length dimension thereof identified by the reference numeral 23 in FIG. 3*c*, extend circumferentially over a circular arc on the circumference 12 of the first folding roller 9 and of the second folding roller 10. Depending upon the pocket length 23 in the circumferential direction on the folding rollers 9 and 10, respectively, it is possible to influence the rounded formation 8 in the folding spine 6 of the copy. The open ends 3, 7 of the individual copy layers are represented above the folding table 19, which is only diagrammatically indicated in FIG. 3*a*.

Figure 3B:
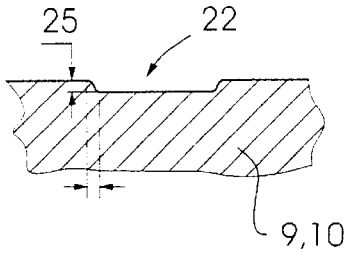
FIGS. 3*b* and 3*c* detail the dimensions of the pockets formed in the circumferential surfaces of the folding rollers according to FIG. 3.
Figure 3C:
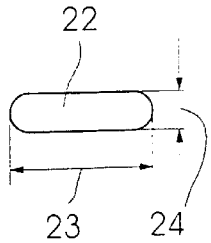

The configuration of the pockets 22 on the circumferential surfaces 12 of the first folding roller 9 and of the second folding roller 10 is illustrated in greater detail in FIG. 3*b*. Analogous to the depth 18 of the annular recess 13 which is illustrated in FIG. 2*a*, the pocket depth 25 is also approximately 0.5 mm here, which is sufficient for forming the non-folded regions in the region of the folding spine 6 on the copies. According to FIG. 3*c*, as aforementioned, the length of the pockets 22 in the axial direction is identified by reference numeral 23, while the extent of the pockets in the circumferential direction is identified by reference numeral 24.

Figure 4:
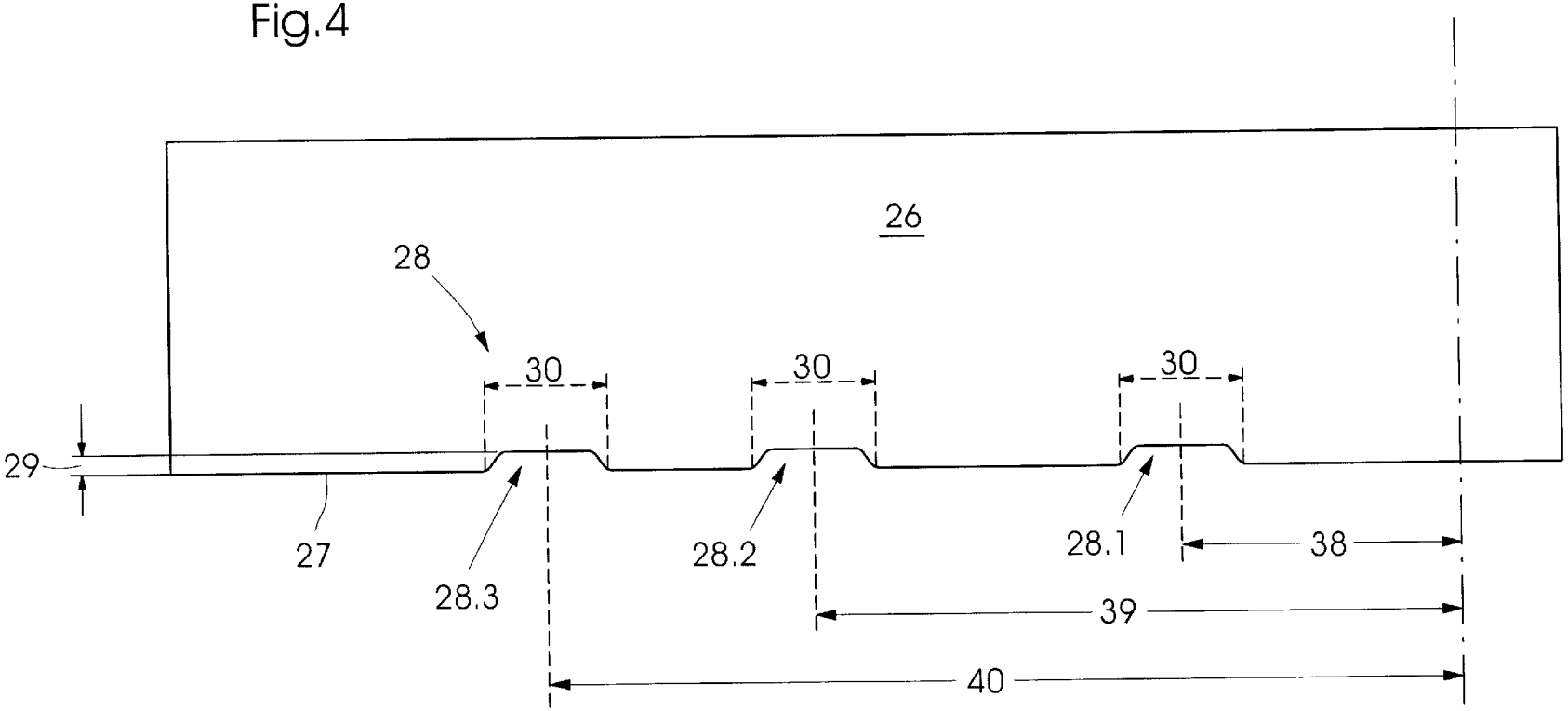
FIG. 4 is a diagrammatic side view of a folding component formed as a folding blade that is reciprocatingly movable and is intended for a second longitudinal folding arrangement in a folder.

FIG. 4 is a side view of a folding blade of a second longitudinal folding device. In a second longitudinal folding arrangement, which is accommodated in a folder, the folding component 26, which is formed as the folding blade, cooperates with the rotating folding rollers illustrated in FIGS. 2 and 3. A reciprocating movement of the folding blades 26 causes the individual layers 4, 6 of the multilayered folding copy 1 to be pushed into the folding-roller nip 11, which is defined by mutually cooperating jacket surfaces 12 of the first folding roller 9 and of the second folding roller 10. In the embodiment of a folding blade 26 according to FIG. 4, cutouts or recesses 28 are provided on a folding edge 27 thereof, which comes into linear contact with the individual copy layers. The cutouts or recesses have a recess width 30 which determines the length of the non-folded sections 41 (note FIG. 6) in the folding spine 6. Analogous to the view according to FIGS. 2*a* and 3*b*, the depth 29 of the individual recesses in this case is only approximately 0.5 mm, as a result of which it is possible to form non-folded regions in the folding spine.

In the embodiment according to FIG. 4, three recesses 28.1, 28.2 and 28.3 are located in the region of the folding edge 27 of the folding blade 26. In relation to a vertically extending reference edge, as viewed in FIG. 4, the first recess 28.1 is located at a spacing 38 from the reference edge, which indicates the position of stapling, stitching or binding in the head region of the A4 folding format. The second recess 28 in the region of the folding edge 27 is provided at a spacing 39 from the reference edge, thus defining the position of stapling, stitching or binding in the delta format. Finally, the recess 28.3 is located at a spacing 40 from the reference edge, designating the position of stapling, stitching or binding in the foot region of an A4 format. In relation to the reference edge illustrated in FIG. 4, the annular recesses 13, respectively, accommodated on the circumference of the folding roller 9 and the second folding roller 10, respectively, and/or the pockets 22 according to FIG. 3, are likewise provided at the spacings 38, 39 and 40, with the result that the recesses 28.1, 28.2 and 28.3 of the folding blade 26 coincide with the position of the annular recess 13 on the circumferential surface 12 of the folding rollers, and the pockets 22 on the circumferential surfaces of the folding rollers, respectively.

Figure 5:
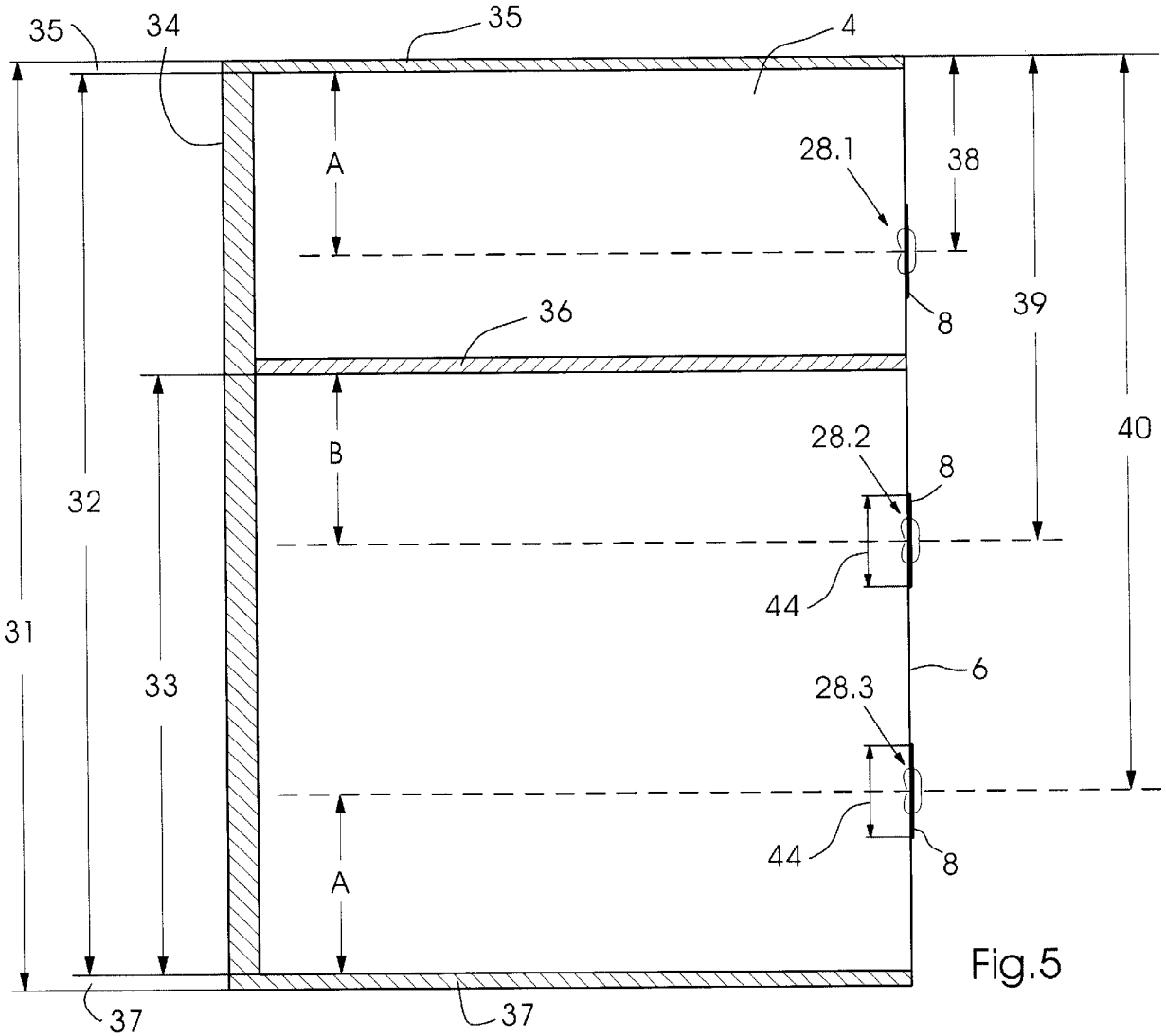
FIG. 5 is a view showing the positions of connecting elements in non-folded regions in the vicinity of a folding spine, both for an A4 folding format and for a delta folding format.

In FIG. 5, the position of the connecting elements, which connect the individual copy layers to one another, is illustrated in greater detail, and the material regions which are to be severed within the context of subsequent further-processing steps are marked by hatching.

The central layer 4 has an untrimmed length 31 from which, during later cutting-to-length operations, a waste strip 35 is severed in the head region and a waste strip 37 is severed in the foot region, due to which the copy layer 4 is cut to a copy length A4 designated 32. The vertically extending border 34 is also severed from the copy layer 4. The copy length 33 of a delta folding copy, which may likewise be produced from the copy layer 4, is also depicted in FIG. 5. In the delta format, a waste strip 36 has to be severed from the copy layer 4.

FIG. 5 shows the position of the individual rounded formations 8 in the region of the folding spine 6 of the central layer 4. The connecting elements, by which the individual copy layers, i.e., the copy layer 4 as well, are connected to the rest of the copy layers of a multilayered copy, are designated 28.1, 28.2 and 28.3. Staples or stitches serve as connecting elements here. The staples or stitches are arranged in the non-folded regions of the rounded formation 8 and, for example, in relation to the length 32 of A4 folding copy, are arranged at the spacing A, which may be, for example, approximately 60 mm, i.e., at the spacings 38 and 40 from the head of the A4 copy.

It is also believed to be apparent from FIG. 5 that the rounded formations 8, in the region of the folding spine 6 on the central layer 4, have a longitudinal extent which is designated 44 in FIG. 5. The longitudinal extent 44 exceeds the height of the individual connecting elements, in this case, for example, staples or stitches. Viewing the copy length 33 of a delta folding copy, it is clear that, for this folding-copy format, the connecting elements are introduced in the rounded formations 8 at positions 28.2 and 28.3 in the folding spine 6 of the delta folding copy. In relation to the top edge of an A4 folding copy, the top connecting element for the delta folding copy is located in position 28.2 at the spacing 39 from the top edge of the A4 folding copy. The connecting element in position 28.2 is arranged at the spacing B from the top edge of the waste strip 36.

Figure 6:
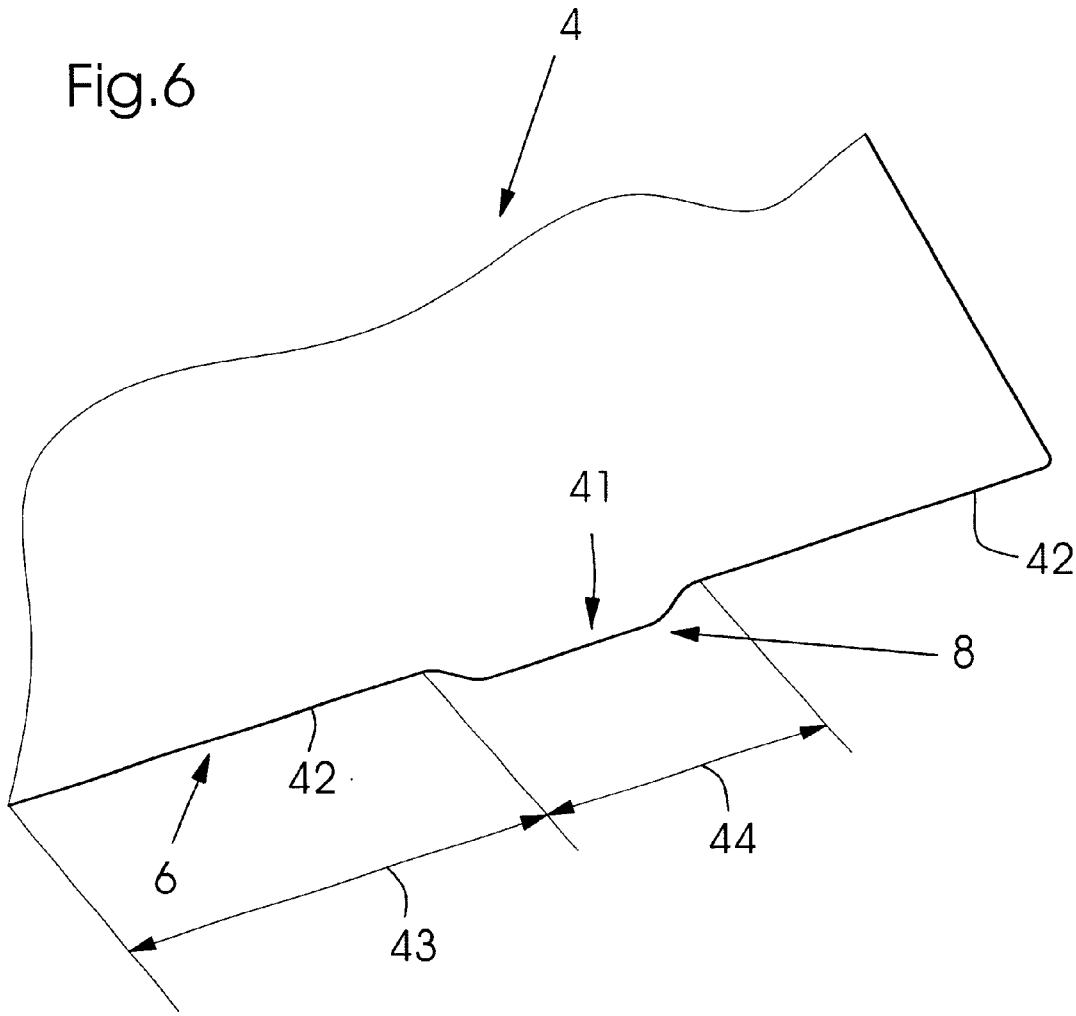
FIG. 6 is a diagrammatic perspective view of a non-folded region on a folding spine on a central layer of a multilayered folding copy.

The central layer 4 of a multilayered copy is illustrated on an enlarged scale in FIG. 6. Along the folding spine 6 of the central layer, non-folding regions 41 and longitudinally folded regions 42 are illustrated in sequence, a rounded formation 8 being indicated in the non-folded region 41. The rounded formation 8 of the non-folded region 41 extends over a length 44, which advantageously (note FIG. 5 and FIG. 6) coincides with the recess width 30 of the recesses on the folding edge 27 of the folding blade 26. Furthermore, the dimension 44 of the non-folded regions 41 in the region of the folding spine 6 of the central layer coincides with the width of the annular recesses or cutouts 13 on the first folding roller 9 and the second folding roller 10 according to FIG. 2 and, with the position of the width 23 of the pockets 22 on the circumferences of the first folding roller 9 and the second folding roller 10 according to FIG. 3.

The folding components which cooperate according to the invention and are configured in accordance with the foregoing description allow the innermost copy layers of a multilayered copy to be produced so that longitudinally folded regions 42 and non-folded regions 41 alternate with one another in the region of the folding spines, as a result of which the mechanical strength of the innermost copy layers 4 and 5 is improved to a considerable extent in the direction of grain. Due to the improvement of the mechanical strength in the grain direction, the connecting elements, which are introduced into the non-folded regions 41 and are in the form of staples or stitches, ensure that even the innermost copy layers 4 and 5 remain permanently connected to the rest of the layers of a multilayered copy and, when a multilayered copy is opened, it is not possible for individual copy layers, in particular the inner individual copy layers, to drop out.

I claim:

1. A method for folding a sheet-like multilayered folding copy made up of a plurality of copy layers, the copy being formed by folding operations with an open end and a closed folding spine, the method comprises:

providing folding components including a pair of folding rollers and a folding blade acting linearly on the copy layers of the multilayered folding copy;

providing the folding rollers with surfaces being interrupted by recesses distributed along a direction of the folding spine;

providing the folding blade with recesses formed therein in a region of a folding edge, the recesses of the folding blade having positions coinciding with positions of the recesses of the folding rollers; and forming the folding spine with longitudinally folded sections interrupted by non-folded sections.

2. The method according to claim 1, which includes maintaining the folding spine rounded in the region of the non-folded sections.

3. The method according to claim 1, which includes locating the non-folded sections of the folding spine in a region of stapling or stitching positions.

4. The method according to claim 3, which includes arranging the stapling or stitching positions on the folding spine in a format-dependent manner.

5. The method according to claim 1, which includes forming the folding spine parallel to the grain of material forming the copy.

6. The method according to claim 1, which includes forming the folding spine with non-folded sections by pushing the copy layers into a nip between folding rollers.

7. The method according to claim 1, which includes forming the folding spine with non-folded sections, during a cross-folding operation, upon transfer of the copies from one copy-guiding cylinder to a next following copy-guiding cylinder.

8. A device for folding a sheet-like multilayered folding copy made up of a plurality of copy layers, the copy being formed by folding operations with an open end and a closed folding-spine, the device comprising:

folding components for producing the folding-spine on the multilayered folding copy, said folding components including a pair of folding rollers and a folding blade provided for acting linearly on the copy layers of the multilayered folding copy;

said folding rollers having surfaces for forming the folding spine on the copy layers of the multilayered folding copy, said surfaces being interrupted by recesses distributed along a direction of the folding spine for forming the folding spine with longitudinally folded sections interrupted by non-folded sections; and said folding blade having a folding edge and recesses formed therein in a region of said folding edge, and said recesses of said folding blade having positions coinciding with positions of said recesses of said folding rollers.

9. The device according to claim 8, wherein said recesses are formed on the folding components with a width corresponding to a measurement of the non-folded sections, and said width exceeds a height of connecting elements for binding the layers of the multilayered folding copy.

10. The device according to claim 8, wherein said recesses have a depth in the folding components which produces spaces, in the region of the folding spine, for surrounding connecting elements.

11. The device according to claim 8, wherein said recesses are arranged on the folding components in a format-dependent manner.

12. The device according to claim 11, wherein, for stapling or stitching positions for a first folding format, said recesses are arranged along the direction of the folding spine at a given spacing A on an untrimmed length of the copy layers.

13. The device according to claim 11, wherein a recess, for a stapling or stitching position for a second folding format, is arranged at a given spacing B approximately in the center of an untrimmed length of the copy layer along the direction of the folding spine.

14. The device according to claim 8, wherein said recesses of said folding rollers are provided as a revolving annular groove formed in said folding rollers defining a folding nip.

15. The device according to claim 8, wherein said recesses are formed as pockets in jacket surfaces of the folding components formed as folding rollers.

16. The device according to claim 15, wherein said pockets are formed on the circumference of said folding rollers so that said pockets extend over a circular-arc sector of the respective jacket surface.

17. A folder for folding a sheet-like multilayered folding copy made up of a plurality of copy layers, the copy being formed by folding operations with an open end and a closed folding-spine, the folder comprising:

folding components for producing the folding-spine on the multilayered folding copy, said folding components including a pair of folding rollers and a folding blade provided for acting linearly on the copy layers of the multilayered folding copy;

said folding rollers having surfaces for forming the folding spine on the copy layers of the multilayered folding copy, said surfaces being interrupted by recesses distributed along a direction of the folding spine for forming the folding spine with longitudinally folded sections interrupted by non-folded sections; and said folding blade having a folding edge and recesses formed therein in a region of said folding edge, and said recesses of said folding blade having positions coinciding with positions of said recesses of said folding rollers.

* * * * *